US005251462A

United States Patent [19]

Shima

[11] Patent Number: 5,251,462

[45] Date of Patent: Oct. 12, 1993

[54] KNIT RUN CAM

[75] Inventor: Masahiro Shima, Wakayama, Japan

[73] Assignee: Shima Seiki Mfg. Ltd., Japan

[21] Appl. No.: 651,965

[22] Filed: Feb. 7, 1991

[30] Foreign Application Priority Data

Feb. 14, 1990 [JP] Japan ..... 2-33327

[51] Int. Cl.[5] ..... D04B 15/36

[52] U.S. Cl. ..... 66/78; 66/77; 66/75.1; 66/71

[58] Field of Search ..... 66/77, 78, 75.1, 64, 66/57, 23, 54, 55, 71

[56] References Cited

U.S. PATENT DOCUMENTS 4,470,274 9/1984 Shima et al. ..... 66/78 X
4,510,755 4/1985 Shima ..... 66/77 X
4,554,802 11/1985 Goller et al. ..... 66/77 X
4,643,003 2/1987 Schmodde ..... 66/78
4,729,230 3/1988 Schmoddle et al. ..... 66/78 X
4,805,423 2/1989 Hoya et al. ..... 66/78

*Primary Examiner*—Clifford D. Crowder
*Assistant Examiner*—Larry D. Worrell, Jr.
*Attorney, Agent, or Firm*—Barnes, Kisselle, Raisch, Choate, Whittemore & Hulbert

[57] ABSTRACT

A knit run cam for vertically moving a needle when fabrics are knitted. There is provided a knit run cam comprising two cams having a needle butt lowering bevel overlapped in a range of at least a part of the same phase in a moving direction of a carriage, one cam having a needle butt lowermost position higher than the other cam.

3 Claims, 3 Drawing Sheets

KNIT RUN CAM

BACKGROUND OF THE INVENTION

1. Field of the Invention

The present invention relates to a knit run cam for vertically moving a needle when fabrics are knitted.

2. Related Art Statement

A needle for knitting fabrics is moved up and down by placing a needle butt projected from the needle in contact with a cam for vertically moving the needle provided on a carriage, and vertically moving the needle as the carriage moves. In a needle having only one butt, a needle not lowered by a knitting cam for lowering the needle is lowered by a further succeeding guide cam, and the range where the needles, which have to be lowered by the guide cam of the carriage, are present increases. As a result, the number of needles which have to be operated and present in the range increases and the load applied to the carriage is increased. Since the needle does not lower to a resting position until the needle is lowered by a succeeding guide cam, a stitch presser bar which moves along a mouth portion of a needle bed together with the carriage needs to cover the range where the needles which are not lowered to a resting position are present so that the stitch presser bar itself should be lengthened, resulting in the cause of trouble.

In the past, for example, in case of fabrics having intershaped patterns, the boundary between the patterns consists of tuck stitches followed by a pattern of knit stitches unavoidably resulting in an unfavorable external appearance in that a loop in the boundary of the patterns is formed too large because the length of the stitch is increased.

OBJECT AND SUMMARY OF THE INVENTION

In view of the foregoing, it is an object of the present invention to relieve a load when a knitting needle is lowered, to remove the cause of trouble occurrence resulting from lengthening the stitch presser, and to prepare four sizes of knitted stitches, i.e., tuck stitches, knitted stitches, stitches of standard size and small size, respectively.

There is provided a knit run cam system comprising a knitting cam and a fixed guide cam which have a needle butt lowering inclined face, respectively, and the inclined faces are arranged to be overlapped in a range of at least a part on the same phase in a vertical direction of a cam lock, said fixed guide cam having a needle butt lower most position higher than that of the knitting cam.

The knit needle is moved upward to a knit position by a raising cam, and after the feed of yarn, the needle is lowered to the lowest position by a knitting cam. The needle is disengaged from the knitting cam when it is lowered from the tuck position, without being lowered to the lowermost position by the knitting cam, and is lowered by the knitting cam and by a fixed guide cam having a needle butt lowering bevel overlapping the knitting cam in a range of at least a part on the same phase of a cam plate in a moving direction of the carriage.

BRIEF DESCRIPTION OF THE DRAWINGS

The drawings show embodiments of the apparatus according to the present invention.

FIG. 2 is a side view of a needle, a select jack, a selector and the like;

DETAILED DESCRIPTION OF PREFERRED EMBODIMENTS

One example of an embodiment of an apparatus according to the present invention will be described hereinafter together with the drawings.

Figure 1:
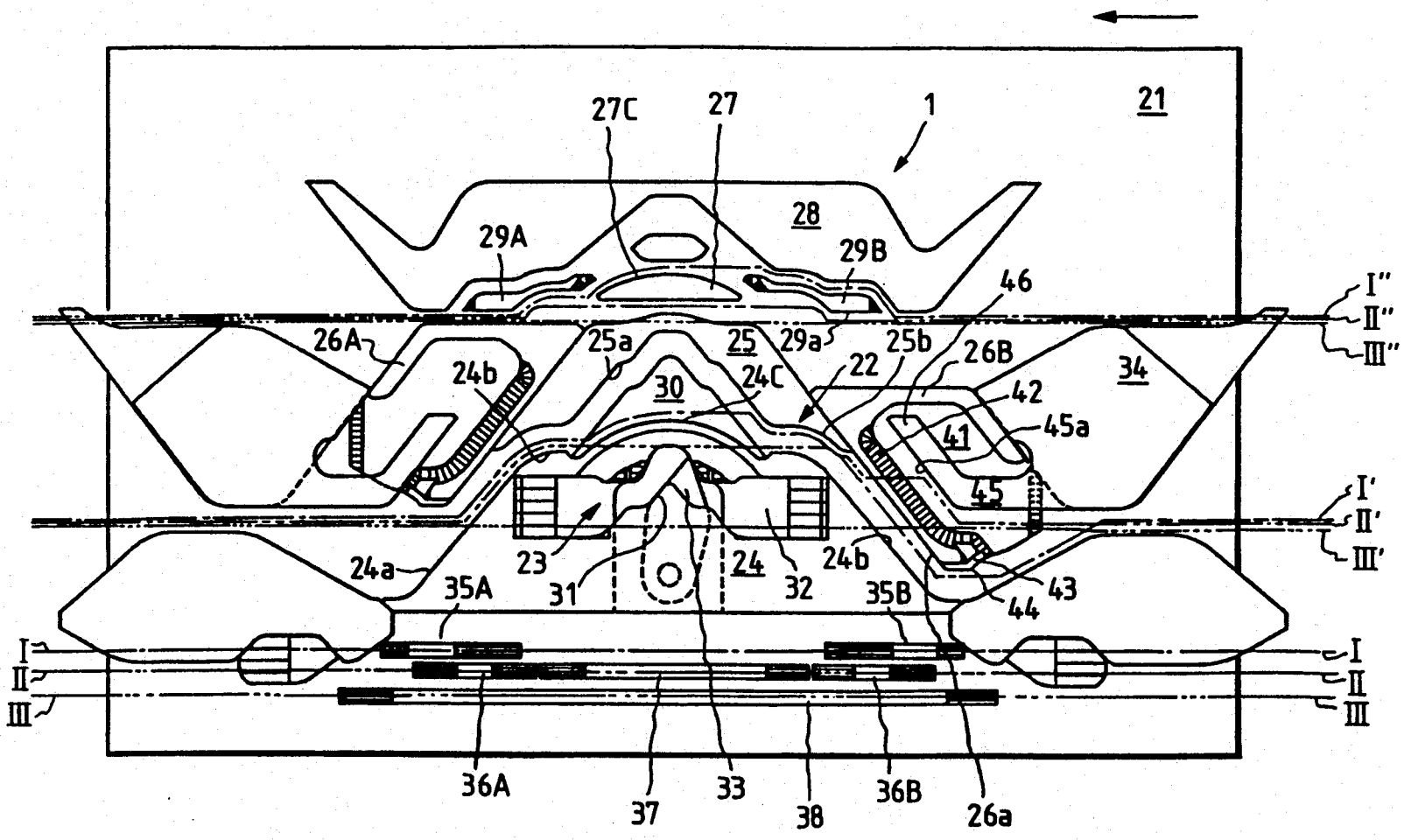
FIG. 1 shows an arrangement of a cam in the state where a cam lock is provided on a cam plate of a carriage is viewed from the lower surface.
Figure 2:
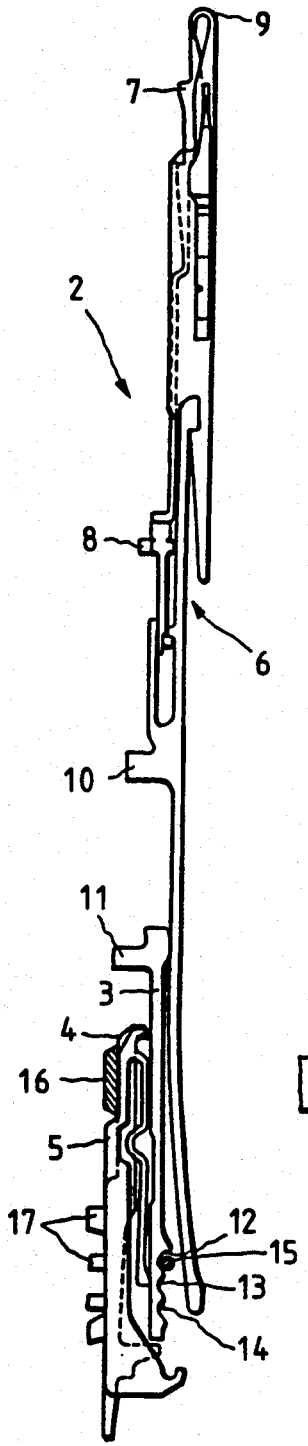
Figure 4:
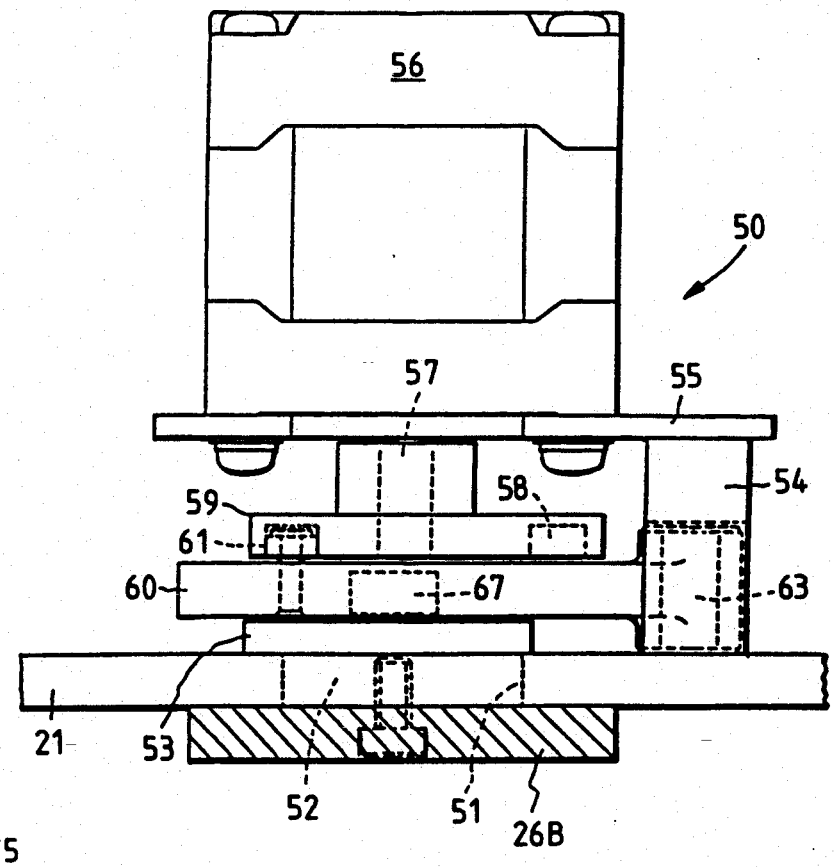
FIG. 4 is a front view of the same.

FIG. 1 shows the state wherein a cam lock 1 of a carriage is viewed from a lower surface, and FIG. 2 shows sides of a needle 2, a select jack 3, a selector 4, a select jack presser 5 and the like placed at a position corresponding to the cam lock 1.

The needle 2 used in the apparatus according to the present invention comprises a compound needle which is designed so that a slider 7 is slidably inserted into an upper portion at the extreme end of a needle body 6, and a slider butt 8 can be operated whereby a hook 9 of the needle body 6 can be opened and closed by the slider 7. Reference numeral 10 designates a needle butt provided on the needle body 6. A select jack butt 11 is provided at its base with depressions 12, 13 and 14. One of the one of the depressions 12, 13 and 14 engages with a wire 15 provided through a needle bed (not shown) to define a position of the select jack butt 11. The select jack butt 11 assumes a welt position when the wire 15 engages the depression 12, assumes a tuck position when engaging the depression 13 and assumes a knit position when engaging the depression 14. The select jack presser 5 comprises a channel-shaped elastic plate which is designed so that the upper edge thereof is brought into a web 16 inserted through a needle bed (not shown) to press the select jack 3 by the end thereof and urge the select jack butt 11 in an upward direction. Reference numeral 17 designates a selector butt of the selector 4.

The cam lock 1 comprises a knitting lock 22 and a transfer lock 23 provided on a cam plate 21.

The knitting lock 22 comprises a raising cam 24 having a trapezoid both bevels of which serve as raising cam surfaces **24*a* and 24*b*, a trapezoidal center cam 25 having an angle recess cam 25*a* provided on the same center line as that of the raising cam 24, left and right knitting cams 26A and 26B vertically slidably, provided on both sides of the center cam 25 which is formed to be substantially trapezoid, a crescent slider guide cam 27 provided at an upper level of the center cam 25, and slider guide cams 29A and 29B provided on both sides of the slider guide cam 27 to guide the butt 8 of the slider 7, along with a guide cam 28, moved upward by the slider cam 27**.

The transfer lock 23 comprises a trapezoidal stitch transfer raising cam 30 positioned at a trapezoidal top of the raising cam 24 and having a height enough to move the needle 2 up to a stitch transfer position, a stitch receiving needle raising cam 33 slidably provided within a depression 32 formed with an angle frictional surface 31 in the central portion of the raising cam 24, and a center cam 25 which also comprises a cam constituting a part of the knitting lock 22. Reference numeral 34 denotes a fixed guide cam.

Below the raising cam 24 are provided a pair of pressers 35A and 35B acting on the select jack butt 11 at the knit position to urge the butt 10 of the needle 2 down to a half position defined as half the depth of the needle groove in which it is received, a pair of pressers 36A and 36B acting on the select jack butt 11 at the tuck position to urge it down, a presser 37 positioned in the middle therebetween, and a presser 38, which is wider than the width of the raising cam 24, acting on the select jack butt 11 at a welt position.

Next, the construction of the knitting cam 26 will be described hereinafter. The knitting cams 26A and 26B are symmetrically supported on the raising cam surfaces 24a and 24b of the raising cam 24 so that the cams may be slidably moved up and down with respect to the cam plate 21.

In the following, the knitting cam 26B will be described. The knitting cam 26B has a surface with respect to the raising cam surface 24b of the raising cam 24, said surface serving as a loop forming lowering cam surface 26a. The knitting cam 26B provides a recessed portion 41 at the central portion thereof and the inclined face 42 is formed toward the recessed portion 41 from a portion positioned slightly inwardly of the stitch forming lower cam surface 26a. The lower end following the lowering cam surface 26a is formed with a stepped portion 43 having a height at which the butt at a half position can pass through, and the needle having the butt at the half position is lowered to the shoulder. The needle having a butt at the full position, where it is not entirely pressed into the needle groove, is lowered to the lowermost end 44 so that fabrics with various densities can be knitted. A lowermost end extension or extending portion 45 extending into the depression 41 of the knitting cam 26B is provided in the guide cam 34. The extending portion 45 has its one side which serves as the lowering cam surface 45a for to lower a needle to form tuck stitches, the lowering cam surface 45a being parallel with the loop forming lowering cam 26a of the knitting cam 26B.

In the knitting cams 26A and 26B, elevating means is symmetrically constituted. Therefore, a stitch cam control device 50 of the knitting cam 26B will be described hereinafter.

The cam plate 21 is formed with a slot 51 for obliquely vertically moving the knitting cam 26B so that a sliding member 52 is slidably received in the slot 51. The knitting cam 26B and a keep member 53 are fixed integral with the sliding member 52 to the lower surface and the upper surface of the sliding member 52, respectively. A stitch cam control motor 56 is mounted through a motor mounting plate 55 on an inverted channel-shaped base bed 54 provided on the upper surface of the cam plate 21. A stitch cam control cam 59 having a spiral cam groove 58 is mounted on a motor shaft 57 of the stitch cam control motor 56. A cam follower 61 provided on a stitch cam control lever 60 is retained in the cam groove 58. The stitch cam control lever 60 is pivotably supported on a shaft 63 within the depression 62 of the base bed 54, a cam follower 61 is supported on the central portion thereof and a holding lever 64 is supported by a shaft 65. The extreme end of the holding lever 64 comes into contact with a bent portion 66 at the extreme end of the stitch cam control lever 60, and a cam follower 67 supported on the upper surface of the keep member 53 is held by the holding lever 64 and the stitch cam control lever 60. A spring 68 is provided between the other end of the holding lever 64 and the stitch cam control lever 60 so that the holding lever 64 and the bent portion 66 at the extreme end of the stitch cam control lever 60 are always in contact with each other to constitute a shock absorbing mechanism.

Figure 3:
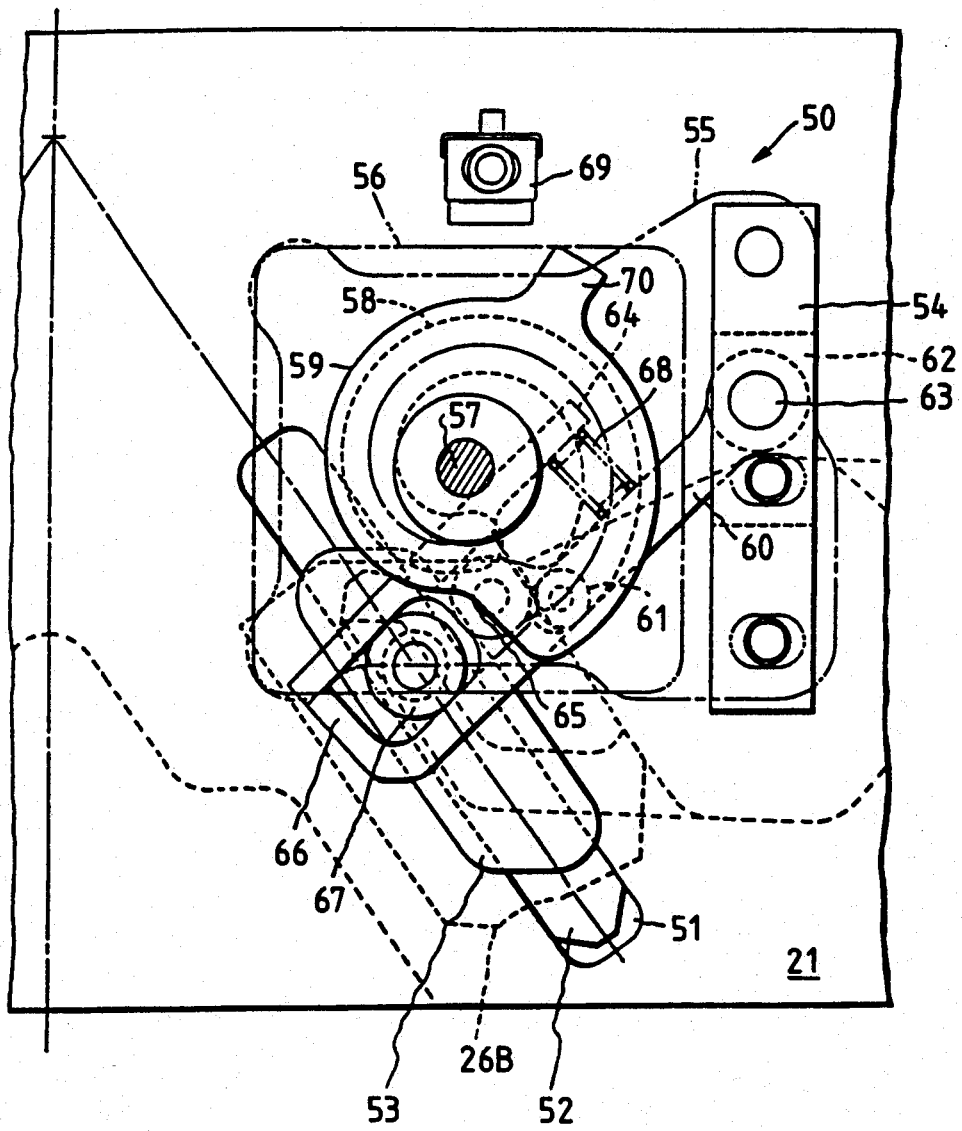
FIG. 3 is a plan view of a stitch cam control device.

Reference numeral 69 designates a proximity sensor for detecting an O-position of the stitch cam control cam 59 so that when a projecting portion 70 of the stitch cam control cam 59 comes near, the sensor detects the O-position to stop the stitch cam control motor 56. The O-position is the position of the cam follower 61 in the cam groove 58 of the stitch cam control cam 59 at the center of the cam 59 that is, the position closest to the motor shaft 57, and a projecting portion 70 of the stitch cam control cam 59 is close to the proximity sensor 69. At this time, the knitting cam 26B is at the uppermost position, and when the stitch cam control device 50 is in the position as shown in FIG. 3 the knitting cam 26B is at the lowest position.

Next, the knitting operation will be described. In knitting fabrics, it is assumed that the carriage is moved in a direction indicated by the arrow in FIG. 1. Selection of the knit, tuck and welt positions of the needle 2 in the knitting is accomplished by conventional known means. The select jack butt 11 corresponding to the needle for raising to the knit position assumes a height position of I. At that time, the pressers 35a and 35b determine function or non-function according to the density of fabrics to be knitted. That is, in the knitting for the standard density, the pressers 35A and 35B are withdrawn so as not to act on the select jack butt 11. The butt 10 of the needle comes into contact with the raising cam surface 24a of the raising cam 24 and moves upward along the cam surface 24a as shown in FIG. 1 (I'). At that time, the stitch transfer raising cam 30 goes down and therefore the needle butt 10 does not come into contact with the cam 30 but moves to the top 24C of the raising cam 24. During that period, the slider butt 8 also moves as indicated by the FIG. 1 line I", and when the slider butt 8 is at the lower edge straight line portion of the slider guide cam 29A, the extreme end of the slider 7 is disengaged from the hook 9 due to the difference in upward movement between the needle body 6 and the slider 7 to open the hook 9. Yarn is fed to the hook 9 of the needle 2 which has passed through the top 24C of the raising cam 24 and the top 27C of the slider guide cam 27. As the carriage advances, the needle butt 10 contacts the lowering cam surface 25b of the center cam 25 and the lowering cam surface 26a of the knitting cam 26B and moves down but the slider butt 8 is held between the guide cam 28 and the slider guide cam 29B and moves substantially horizontally during which the needle 2 moves down while the end of the slider 7 does not move down. Therefore, the end of the slider relatively comes close to the hook 9 to close the hook 9. The needle butt 10 of the needle 2 lowered by the lowering bevel 26a of the knitting cam 26B is at a full height since the presser 35B goes down so that the select jack butt 11 is not pressed. The needle butt 10 is lowered to the lowermost end 44 of the knitting cam to pull the yarn previously fed to produce fabrics having the standard density.

When the needle butt 10 is lowered by the lowering cam surface 26a of the knitting cam 26B, the presser 35B is actuated to force the select jack butt 11 into the half position and to set the needle butt 10 of the needle 2 to the half position through the select jack 3. The needle butt 10 of the needle 2 which has received the yarn and has been moved down along the lowering cam surface 26a of the knitting cam 26 arrives near the lowermost end 44 of the knitting cam 26B. The needle butt 10 passes through the stepped portion 43 at the half height so that the lowering amount of the needle 2 becomes less than that at the time of knitting ordinary stitches. Therefore, stitches knitted by the needle 2 are somewhat small. While in the foregoing, whether the standard stitches or small stitches is discriminated according to the passage through the lowermost end 44 or the stepped portion 43 of the knitting cam 26B, it is to be noted that the knitting cam 26 itself may be moved up and down in the following manner.

That is, in the course in which the carriage runs in the direction as indicated by the arrow, it is necessary that the preceding knitting cam 26A is raised whereas the succeeding knitting cam 26B is lowered. The stitch cam control device 50 of the knitting cam 26B rotates until the stitch cam control cam 59 has moved up to the uppermost position where it remains until termination of the knitting in the previous course and is then rotated to the position at which the projecting portion 70 opposes to the proximity sensor 69 causing the knitting cam 26B to be lowered to a predetermined density position. The rotary angle of the knitting cam control motor 56 determines the lowering position by suitably inputting the number of pulses during the rotation of the motor according to the position thereof. The knitting cam control cam 59 as shown in FIG. 3 has been rotated by the rotation of the knitting cam control motor 56 to where the knitting cam 26B has been lowered to the lowest position causing the extreme end of the stitch cam control lever 60 to be lowered through the cam follower 61 retained in the cam groove 58 of the cam 59 to lower the cam follower 67 engaged with the bent portion 66 at the extreme end thereof to determine the lowering position of the knitting cam 26B.

In knitting the tuck stitches, the select jack butt 11 is set to the position II. When the carriage advances as indicated by the arrow, the select butt 11 of the selector 4 and the needle butt 10 of the needle 2 move along the lines II and II', respectively. At this time, the pressers 36A and 36B go down whereas the presser 37 projects. The needle butt 10 comes into contact with and moves along the raising cam surface 24*a* of the raising cam 24 but when the needle butt 10 reaches the portion 24*b* of the shoulder of the raising cam 24, the select jack butt 11 is pushed in by the projecting presser 37 and therefore the needle butt 10 does not come to the top of the raising cam 24 and moves crossing thereover. At this, time, the slider butt 8 moves horizontally until it passes through the straight line edge 29*a* of the slider guide cam 29*a* similarly to the needle which moves up to the aforesaid knit position. Therefore, the hook 9 is moved away from the extreme end of the slider 7 due to the upward movement of the needle butt 10 of the needle body 6 to open the hook 9. However, the needle butt 10 does not come to the top of the raising cam but moves crossing thereover as mentioned above, and therefore the slider butt 8 is also not moved upward further but passes through under the slider guide cam 27 while the hook 9 remains opened and is lowered by the lowering cam surface 29*b* of the slider guide cam 29B, after which the slider butt 8 moves horizontally.

The needle butt 10 which has crossed the top of the raising cam 24 lowers along the lowering bevel 25*b* of the center cam 25 and the lowering bevel 26*a* of the knitting cam 26 and runs taking the same course as the needle 2 which has moved up to the knit position and lowered to the lowermost end of the knitting cam 26 to knit tuck stitches having the standard density.

On the other hand, when the presser 36B is projected with respect to the needle 2 which has not moved up to the top of the raising cam 24 by the action of the presser 37 but moved up to the shoulder portion 24*b* (tuck position) to receive a yarn and started to be lowered by the center cam 25, the needle butt 10 goes down at that position to be disengaged from the lowering bevel 26*a* of the knitting cam 26 so that at that position, the needle butt 10 jumps the lowering bevel 26*a* of the knitting cam 26 and moves horizontally. When the select jack butt 11 is released from being pressed by the presser 36B, the needle butt 10 again projects and enters the course 46 between the knitting cam 26 and the extending portion 45 of the fixed guide cam 34 and comes into contact with the lowering bevel 45*a* of the fixed guide cam 34 so that the needle butt 10 is lowered to the lowermost end. During that period, the slider butt 8 horizontally passes through the lower edge of the straight line edge 29*a* of the slider guide cam 29B to feed yarn to the hook 9 but the needle butt 10 comes into contact with the lowering bevel 45*a* of the fixed guide cam 34 so that the hook 9 is closed caused by the lowering of the needle body 6 and the movement of the slider butt 8 toward the extreme end during the movement to the lowermost end. When the hook 9 is closed, the slider 7 moves along the line II' without reckless movement due to the friction between the slider side and the needle groove wall. The knitting yarn to be fed is pulled to form a loop when the needle butt 10 moves down along the lowering guide surface 45*a* of the projecting portion 45 of the fixed guide cam 34. Since the lowermost position of the extending portion 45 of the fixed guide cam 34 is higher than the lowermost end 44 of the knitting cam 26B, the amount of the yarn pulled by the needle at the lowermost end of projecting portion 45 is less than that pulled by the needle at the lowermost end 44 and accordingly, tuck stitches which are small in density are knitted.

When the welt position at which the needle 2 is not at all moved upward is employed, the select jack butt 11 is set to the position III of the presser 38. When the presser 38 is projected to move the carriage, the select jack butt 11 is forced in by the presser 38 and accordingly, the needle butt 10 also goes into the needle groove, as a consequence of which the needle butt 11 and the slider butt 8 do not come into contact with any cam of the cam lock 1 but they pass through the positions III' and III'', respectively, and the needle 2 fails to act at all.

While the foregoing, a description has been made in which the position I is the knit position, position II is the tuck position, and position III is the welt position, it is to be noted that even in the position II, the needle can be raised to the knit position unless the presser 37 is acted, and when standard size knit stitches and smaller knit stitches are prepared, the standard size knit stitches and the smaller knit stitches select needles at the position II and position I, respectively, so that the presser 35B is acted similarly to that as described previously to cause it to pass through the stepped portion 43 of the knitting cam 26.

As described above, by using the knit run cam according to the present invention, the knit stitches and tuck stitches of the standard size, and the knit stitches and tuck stitches of smaller than the standard size, are knitted by suitably selecting the position of the needles.

The knit run cam according to the present invention being constructed as described above, four kinds of stitches, i.e., the knit stitches of the standard size, the knit stitches smaller than the former, the tuck stitches of the standard size, and the tuck stitches smaller than the former are mixed in the same course, and therefore there provides the effect that a suitable needle can be suitably selected to the respective knitting position.

Moreover, the cam for lowering knitting needles different in the yarn lowering amount and the cam for lowering the tuck needle can overlap the range for lowering the respective needles in the knitting width direction, and therefore, the range of the provision of the stitch presser bar that has to be provided in the range in which the needle for knitting fabrics lowers to the resting position can be decreased to eliminate the cause of trouble.

Furthermore, in the present invention, the needle lowering number can be decreased, and therefore, the load when the needle is lowered can be reduced. Furthermore, since the cam for knitting tuck stitches can easily shorten the yarn lowering length (density) at a suitable length than the knitting cam, the tuck stitches can be made dense, and if this apparatus is utilized for a portion in the state where a loop formed in the boundary of patterns of pattern fabrics or the like, fabrics in which the boundary of patterns is dense can also be obtained.

What is claimed is:

1. A knit run cam system comprising:

a knitting needle having a needle butt, a knitting cam (26B) having a needle butt lowering inclined face (26*a*) and a lowermost end (44) wherein the needle butt of the knitting needle engages the needle butt lowering inclined face (26*a*) and the lowermost end (44) to form knit and tuck stitches, wherein said knitting cam (26B) has a depression (41), said depression formed at a central portion thereof, and a fixed guide cam (34) having a needle butt lowering inclined face (45*a*) and a lowermost end extension (45) for engagement with the needle butt of the knitting needle to form tuck stitches of decreased density, wherein the needle butt lowering inclined face (45*a*) and the lowermost end extension (45) of said fixed guide cam overlap the depression (41) in said knitting cam (26B) such that the lowermost end extension (45) of said fixed guide cam (34) is spaced from the lowermost end (44) of said knitting cam (26B).

2. A knit run system as claimed in claim 1 wherein the lowermost end (44) of said knitting cam (26B) has a stepped portion (43) for engagement with the needle butt to form knit stitches of decreased density.

3. A knit run cam system as claimed in claim 1 further comprising:

a cam plate (21) having an oblique slot (51) therein, a stitch cam control having a sliding member (52) slidably received in the slot (51) in said cam plate (21) and connected to said knitting cam (26B) for moving said knitting cam (26B) obliquely vertically on said cam plate (21), a stitch cam control motor (56) having a motor shaft (57) mounted on an upper surface of said cam plate (21), a stitch cam control cam (59) having a spiral cam groove (58) mounted on the motor shaft (57), a first cam follower (61) comprising a stitch cam control lever (60) received in the spiral cam groove (58), a second cam follower (67), and means (64) for engaging the stitch cam control lever (60) with the sliding member (52) through said second cam follower (67).

* * * * *